US007717039B2

(12) United States Patent
Becker et al.

(10) Patent No.: US 7,717,039 B2
(45) Date of Patent: May 18, 2010

(54) ROTATING BODIES OF A PRINTING PRESS COMPRISING A BARREL

(75) Inventors: Martin Becker, Arnstein (DE); Karl Robert Schäfer, Rimpar (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 776 days.

(21) Appl. No.: 10/533,437

(22) PCT Filed: Oct. 23, 2003

(86) PCT No.: PCT/DE03/03527

§ 371 (c)(1),
(2), (4) Date: Aug. 23, 2006

(87) PCT Pub. No.: WO2004/039588

PCT Pub. Date: May 13, 2004

(65) Prior Publication Data

US 2007/0214988 A1 Sep. 20, 2007

(30) Foreign Application Priority Data

Oct. 31, 2002 (DE) ..... 102 50 686

(51) Int. Cl.

| | |
|---|---|
| ***B41F 13/22*** | (2006.01) |
| ***B41F 1/28*** | (2006.01) |
| ***B41F 21/00*** | (2006.01) |
| ***B41F 5/00*** | (2006.01) |
| ***B41L 5/16*** | (2006.01) |
| ***B41L 15/14*** | (2006.01) |
| ***B41L 49/00*** | (2006.01) |
| ***F28F 5/02*** | (2006.01) |
| ***F28D 11/02*** | (2006.01) |

(52) U.S. Cl. ..... 101/407.1; 101/480; 101/216; 492/46; 165/89

(58) Field of Classification Search ..... 101/185, 101/217, 285, 375, 376, 401.1, 480, 492, 101/216, 407.1, 487, 488; 492/46; 165/89
See application file for complete search history.

(56) References Cited

U.S. PATENT DOCUMENTS

| | | | | |
|---|---|---|---|---|
| 3,143,637 | A * | 8/1964 | Turner | 392/435 |
| 3,336,648 | A * | 8/1967 | Alexeff | 492/4 |
| 3,406,748 | A | 10/1968 | Jarreby | |
| 3,780,796 | A | 12/1973 | Miram et al. | |
| 4,617,864 | A | 10/1986 | Niedermaier et al. | |

(Continued)

FOREIGN PATENT DOCUMENTS

| | | |
|---|---|---|
| DE | 137401 | 2/1902 |

(Continued)

*Primary Examiner*—Judy Nguyen
*Assistant Examiner*—Leo T Hinze
(74) *Attorney, Agent, or Firm*—Jones, Tullar & Cooper, P.C.

(57) ABSTRACT

A rotating body of a printing press includes a barrel that has a base body and an outer body which at least partially surrounds the base body. The external body, or at least one channel which is located in the barrel is traversed by a temperature control medium. The outer body or the at least one channel is thermally insulated with respect to the base body.

25 Claims, 6 Drawing Sheets

U.S. PATENT DOCUMENTS

| | | | | | |
|---|---|---|---|---|---|
| 4,955,268 | A | | 9/1990 | Ickinger et al. | |
| 5,074,213 | A | | 12/1991 | Kurosawa | |
| 5,111,564 | A | * | 5/1992 | Pav et al. | 100/329 |
| 5,168,808 | A | * | 12/1992 | Prem | 101/375 |
| 5,226,365 | A | | 7/1993 | Wieland | |
| 5,235,912 | A | | 8/1993 | Wieland | |
| 5,595,115 | A | | 1/1997 | Rau et al. | |
| 5,784,957 | A | | 7/1998 | Rau et al. | |
| 5,948,448 | A | * | 9/1999 | Schmidt | 425/192 R |
| 6,105,651 | A | | 8/2000 | Leanna | |
| 6,436,022 | B1 | | 8/2002 | Zaoralek | |
| 6,460,611 | B2 | | 10/2002 | Zaoralek | |
| 6,675,876 | B2 | * | 1/2004 | Yamashita et al. | 165/89 |
| 6,688,223 | B1 | | 2/2004 | Dauner | |
| 6,708,407 | B2 | * | 3/2004 | Leinonen et al. | 29/895.32 |
| 6,810,800 | B1 | * | 11/2004 | Schneider et al. | 101/217 |
| 6,821,237 | B1 | * | 11/2004 | Isometsa et al. | 492/46 |
| 6,868,782 | B2 | | 3/2005 | Dauner | |
| 2002/0066491 | A1 | * | 6/2002 | Lively | 138/149 |
| 2003/0029603 | A1 | * | 2/2003 | Yamashita et al. | 165/89 |

FOREIGN PATENT DOCUMENTS

| | | | | |
|---|---|---|---|---|
| DE | 226624 | | | 10/1910 |
| DE | 629 700 | | | 4/1936 |
| DE | 629700 | | * | 4/1936 |
| DE | 861 642 | | | 1/1953 |
| DE | 929 830 | | | 7/1955 |
| DE | 1 501 622 | | | 5/1965 |
| DE | 2 055 584 | | | 5/1972 |
| DE | 38 19 391 | A1 | | 1/1989 |
| DE | 37 26 820 | A1 | | 3/1989 |
| DE | 40 36 121 | A1 | | 1/1992 |
| DE | 41 19 824 | C1 | | 12/1992 |
| DE | 41 19 825 | C1 | | 12/1992 |
| DE | 93 06 176.5 | | | 8/1993 |
| DE | 42 12 790 | A1 | | 10/1993 |
| DE | 195 10 797 | A1 | | 9/1996 |
| DE | 196 47 067 | A1 | | 5/1998 |
| DE | 199 57 847 | C1 | | 6/2001 |
| DE | 199 57 943 | A1 | | 6/2001 |
| DE | 101 39 821 | A1 | | 4/2002 |
| DE | 103 05 594 | A1 | | 9/2003 |
| EP | 0 179 363 | A2 | | 4/1986 |
| EP | 0 557 245 | A1 | | 8/1993 |
| EP | 0 652 104 | A1 | | 10/1995 |
| JP | 48036541 | A | | 5/1973 |
| JP | 1-249449 | | | 10/1989 |
| JP | 4-9741 | | | 1/1992 |
| JP | 9501763 | | | 12/1995 |
| WO | WO 96/32536 | | | 10/1996 |
| WO | WO 01/26902 | A1 | | 4/2001 |
| WO | WO 01/26903 | A1 | | 4/2001 |

* cited by examiner

ROTATING BODIES OF A PRINTING PRESS COMPRISING A BARREL

CROSS-REFERENCE TO RELATED APPLICATIONS

This patent application is the U.S. national phase, under 35 U.S.C. 371, of PCT/DE2003/003527, filed Oct. 23, 2003; published as WO 2004/039588 A1 on May 13, 2004, and claiming priority to DE 102 50 686, filed Oct. 31, 2002, the disclosures of which are expressly incorporated herein by reference.

FIELD OF THE INVENTION

The present invention is directed to rotating bodies of a printing press with a barrel. The barrel has at least one channel through which a temperature control medium flows.

BACKGROUND OF THE INVENTION

A cylinder of a printing group, which is embodied as a hollow body, is known from DE 41 19 824 C1 and DE 41 19 825 C1. The cylinder consists of a one-piece cast body constituting an outer body and additionally has, if required, an inner one-piece rotationally-symmetrical cast body. The two cast bodies are made, for example, of cast steel or of gray cast iron and, in the case of DE 41 19 824 C1, are embodied in one piece by the use of connecting strips, or are welded together.

A cylinder of a printing group made of gray cast iron is known from DE 42 12 790 A1. For increasing the bending resistance of the cylinder, an axially extending steel core has been cast, centered in the cylinder, which, at the same time, projects as a shaft journal out of the end faces of the cylinder. The gray iron cast cylinder concentrically envelopes the steel core and has hollow spaces.

A cylinder of a printing group is known from DE 196 47 067 A1, which cylinder consists of a base body of gray cast iron or of a light metal casting. A cylinder core, which is preferably hollow, has been cast as a stiffening element in the base body. The cylinder core consists, for example, of a steel pipe. Further reinforcing profiles, extending parallel with the longitudinal axis of the cylinder and having a solid or hollow cross section, and possibly with a non-uniform wall thickness, are arranged in a radially outward located area of the base body, are distributed over the circumference of this area and are preferably brought as closely as possible to the shell face of the base body. The stiffening element, and all of the reinforcing profiles are closed off at their respective ends and are completely surrounded by the cast material of the base body.

A temperature-controllable double-shelled cylinder is known from Patent Publications DE 861 642 B and DE 929 839 B. A heating or cooling medium, which preferably is air, is passed over a helix-like path within the double cylinder shell. The inner cylinder and the outer cylinder are arranged coaxially at a radial distance of approximately 10 to 20 mm from each other.

A temperature-controllable counter-pressure cylinder is known from DE 20 55 584 A, and which has heating chambers in its shell over the entire cylinder width. These heating chambers are connected to a warm water circuit by an inflow line that is arranged axially in a cylinder journal, and an outflow line which is conducted coaxially with the inflow line.

A temperature-controllable printing forme cylinder is known from DE 37 26 820 A1, whose interior is completely filled with a liquid. The liquid passes through a first circuit extending outside of the printing forme cylinder. A cooling pipe, which is preferably coil-shaped, penetrates the liquid over the entire cylinder width. A cooling medium, which flows through the cooling tube and which is connected to a second circuit, cools the liquid and therefore cools the cylinder.

A cylindrical rotating body for printing presses, which can be temperature-controlled by the introduction of water vapor, is known from DE 93 06 176 U1. Bores or lines, which extend along the rotating body closely under its shell face, are utilized. These bores or lines can have a course differing from axial parallelism, and therefore can have a drop toward the center of the rotating body.

A temperature-controllable cylindrical rotating body for printing presses is known from DE 195 10 797 A1. A coolant flows through the entire interior in only one cycle. The rotating body is provided, at one side, with a coolant feed device, and a coolant flow-off device is arranged in a cylinder journal and is connected with a rotary lead-through.

A temperature-controllable printing forme cylinder is known from DE 199 57 943 A1, which, in its interior, has casting core chambers, which chambers extend over the width of the cylinder and which are closed off, at the ends of the cylinder body, by covers. A pipe, extending over the cylinder width, is arranged in each chamber. A sealingly displaceable pipe unit, which is connected with a rotary lead-through for the supply and removal of coolant, is arranged in an axial bore of a cylinder journal. At the end of the cylinder equipped with the pipe unit, every pipe is connected, via a radial bore, with the pipe unit. Coolant is supplied and flows through the pipes and flows into the hollow casting core chambers in the area of the oppositely located end of the cylinder and is conducted away from there via a radial bore connected with the pipe unit.

A temperature-controllable cylinder for a rotary printing group, and which is embodied with almost completely solid walls, is known from EP 0 557 245 A1. This cylinder has a first line along its rotary shaft, and has several second lines closely underneath its shell face, which second lines are connected with the first line, are preferably arranged equidistant in the circumferential direction and extend parallel with the longitudinal axis, and through which lines a fluid can flow for controlling the temperature of the shell face.

A temperature-controllable cylinder for a rotary printing group is known from EP 0 652 104 B1, which cylinder has a cylinder shell pipe, at each one of whose respective ends a flange is arranged. A separating pipe and a feed pipe extend in the interior of the cylinder coaxially in relation to its length. A hollow chamber situated between the separating pipe and the cylinder shell pipe constitutes a cooling chamber, through which cooling chamber a coolant supply via a feed pipe flows. The line in the separating pipe is connected with the cooling chamber via connecting bores in one of the flanges.

A temperature-controllable cylinder for a rotary printing group is known from WO 01/26 902 A1 and WO 01/26 903 A1, which cylinder has a pipe-shaped or a solid cylinder base body, and which is surrounded by a pipe-shaped outer cylinder body. For controlling the temperature of the shell face, a channel is formed on the circumference of the cylinder base body, or in a gap between the cylinder base body and the outer cylinder body, and through which a temperature-control medium can flow. The channel can be configured, for example, as an open gap with a ring-shaped clear profile, or as a groove revolving in a helical manner in the axial direction of the cylinder.

A heating or cooling roller with a roller body with peripheral bores axially in respect to the roller body for a fluid heat-conducting medium is known from DE 40 36 121 A1. It is the object of this prior device to achieve as uniform a temperature profile as possible over the entire roller body. One embodiment of that roller, for the attainment of this object, provides for lining the peripheral bores with heat-insulating materials, so that the amount of heat emitted by the heat-carrying medium to the roller, per unit of length of peripheral bore, is as constant as possible, in spite of resultant temperature differences in the heat-conducting medium. Therefore, the radial expansion and the temperature at the roller surface are kept as uniform as possible. To this end, the insulating material is placed into the bores in such a way that the insulating material continuously changes the diameter of the bores. Thus, the heat transfer from the heat-conducting medium to the roller body, over the length of the bores, is maintained constant by the thickness of the insulating material introduced into the bores, in spite of a temperature drop occurring along the bores.

A device for dampening non-printing locations on planographic printing plates in printing presses is known from DE 629 700 B. A coolant flows through a cooling coil arranged in a plate cylinder. The cooling coil is arranged in a space enclosing an inner part of the plate cylinder with the exception of the cylinder pit, and in particular underneath the printing surface. An insulating layer is arranged between the inner portion of the plate cylinder and the space with the cooling coil. The cooling coil is in metallic contact with the outer wall of the space which faces the printing surface.

A cylinder of a printing press is known from the later published DE 103 05 594 A1. A cylinder is constructed of several layers and, in one embodiment, has an internal temperature-control device, which is embodied as a coolant line, for example. The temperature-control device is arranged between a thermal insulation and a support surface for material to be imprinted, such as, for example, a preferably thin-walled cylinder shell. The thermal insulation can be made of a dimensionally stable material, such as, for example, a metal foam or a ceramic material or, if it has been divided into segments, for example, of a felt or fiber material. DE 103 05 594 A1 expressly does not relate to printing forme cylinders, to rubber blanket cylinders or to inking unit rollers.

SUMMARY OF THE INVENTION

The object of the present invention is directed to providing rotating bodies of a printing press with a barrel.

In accordance with the present invention, this object is attained by the provision of a rotary body with a barrel that includes a base body and an outer body. At least one channel, through which a temperature-control medium can flow, and which has an inflow and an outflow, is in heat exchange contact with the outer body. A thermally insulative insert can be placed in the channel. This insert may surround the base body and may be a castable material.

The advantages to be gained by the present invention reside, in particular, in that in a cylinder or in a roller with a barrel, which cylinder or roller has a base body, and with an outer body arranged radially outwardly of, and at least partially covering the latter, the base body and the outer body are thermally insulated from each other. This is of particular advantage if at least one channel, through which a medium for temperature control flows, is arranged in the barrel. A rapidly reacting and an as uniform as possible temperature control of the shell face of the barrel can be achieved in this way. It is thus possible, by use of the present invention, to increase the efficiency of the heat exchange between the temperature control medium and the outer body, or the shell of the barrel. Furthermore, the thermal insulation can be produced in a simple way, for example by casting techniques. The barrel, as a whole, can also be produced simply and cost-effectively. By optionally provided geometric designs of the channels, it is possible to maintain the effect of the temperature-control medium approximately constant during its flow through the barrel.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
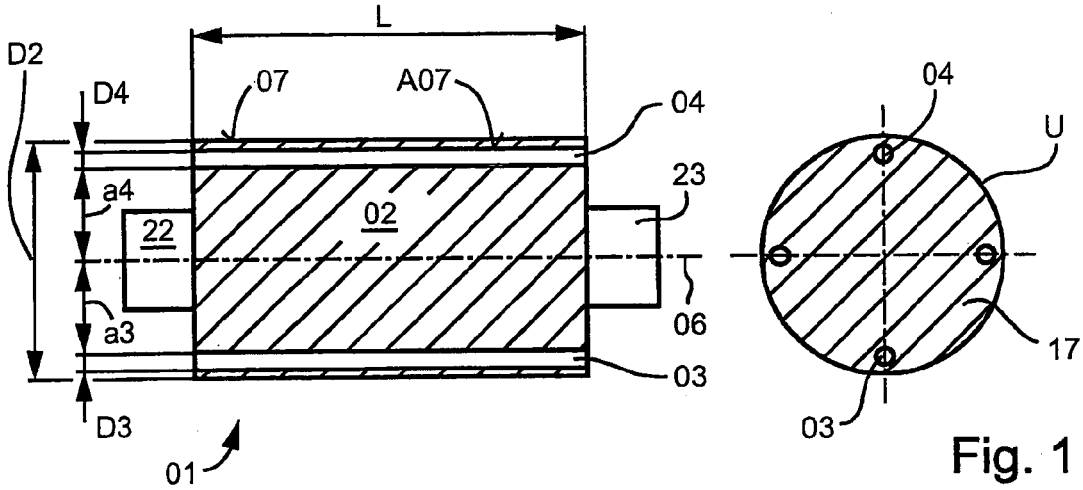
FIG. 1, a longitudinal cross-section and a transonic cross-section of a rotating body of a printing press in accordance with a first preferred embodiment of the present invention and with axially extending hollow bodies, in FIG. 2, a rotating body of a printing press in accordance with the first preferred embodiment with a hollow body extending in a helical line, in FIG. 3, a rotating body of a printing press in accordance with a second preferred embodiment with a body sealed in a barrel and containing a channel, in FIG. 4, a rotating body of a printing press in accordance with a third preferred embodiment with a base body and with a solid outer body attached to it, and where hollow spaces have been cut in the outer body, which hollow spaces are open toward the base body, in FIG. 5, a rotating body of a printing press in accordance with a variation of the third preferred embodiment with a base body and with a solid outer body attached to it, and where hollow spaces have been cut in the outer body, and which are covered by the outer body, in FIG. 6*a*, a rotating body of a printing press in accordance with a fourth preferred embodiment of the present invention and with a channel formed in a space between a base body and an outer body, in FIG. 6*b*, a rotating body of a printing press in accordance with the fourth preferred embodiment and with a channel formed in a space between a base body and an outer body, in FIG. 7, a rotating body of a printing press in accordance with a fifth preferred embodiment with a high-strength shaft introduced into the barrel, in FIG. 8, an embodiment of a hollow body or of a channel of a rotating body with a temperature-controlled shell face, and in which the heat exchange between the shell face and the temperature-control medium is constant, in FIG. 9, a longitudinal section through a rotating body with a base body, and with an outer body and a sleeve, which sleeve is arranged between the base body and the outer body and has flow channels, in FIG. 10, a cross-section through the rotating body represented in FIG. 9, and in FIG. 11, a perspective view of the sleeve which is arranged between the base body and the outer body and which is provided with the flow channels.
Figure 2:
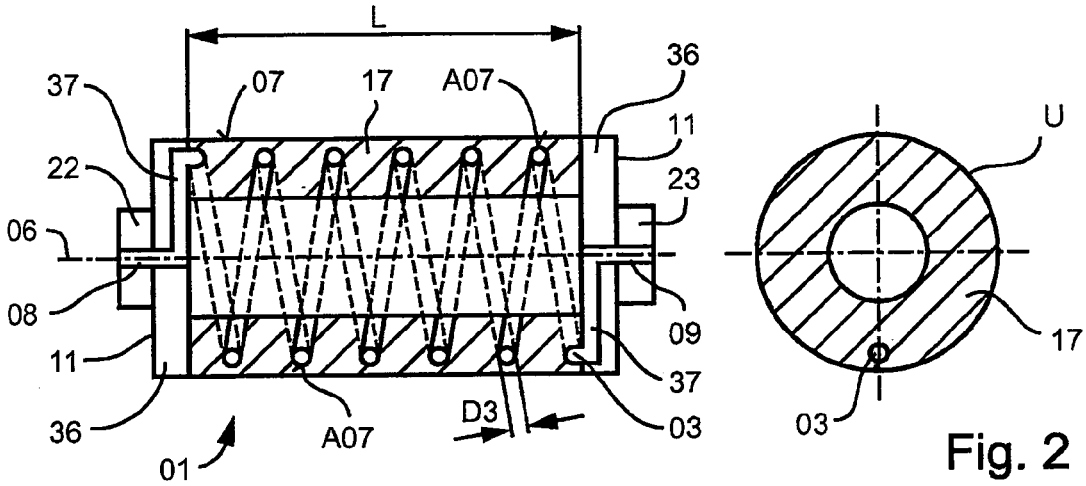

FIGS. 1 and 2 show a first embodiment of a rotating body 01 of a printing press in accordance with the present invention. The rotating body 01 has either a barrel 02, or a barrel 02 with a base body 17. At least the base body 17 is made of a cast material. The barrel 02, or its base body 17, has an axial length L and has, in its outer area, which is its area closely underneath its shell face 07, at least one sealed-in pipe-shaped hollow body or conduct 03, 04, enclosed in cast material, and wherein the hollow body or conduct 03, 04 extends over the entire length L of the barrel 02, or of its base body 17. In accordance with FIG. 1, the hollow body or conduct 03, 04 can extend, for example, parallel with a longitudinal axis 06 of the rotating body 01 or, as represented in FIG. 2, it can extend through the outer area of the barrel 02, or its base body 17 from one end 11 to the other end 11 in a helical path. In the longitudinal cross-section shown in the left in FIG. 2, the helical course of the hollow body or conduct 03 has been drawn in dash-dotted lines for easier understanding of the representation. Regardless of its course, the hollow body or conduct 03, 04 forms a channel, through which a temperature-control medium, typically a flow medium for use in controlling the temperature of at least the shell face 07 of the barrel 02, can flow. The temperature-control medium is preferably a liquid heat-conducting medium such as water or an oil, for example.

To introduce the flow medium into, or to remove it from the barrel 02, the hollow body 03 can be connected with lines 08, 09, which can be attached to the ends of the barrel 02 for example, or which can be introduced there into a flange 36 in the shape of an annular groove 37, as seen in FIG. 2. Also, in the embodiment having several hollow bodies or conducts 03, 04 arranged in the barrel 02, or its base body 17, these conduct 03, 04, as well as the lines 08, 09 connected with them, can advantageously have a common connector on one of the ends 11 of the barrel 02.

It is advantageous, for attaining good temperature control, to arrange the hollow body or conduct 03, 04 with its contact face A07, which is intended for heat exchange, closely, such as, for example only a few millimeters, and preferably less than 20 mm, underneath the shell face 07 of the barrel 02. If several hollow bodies or conducts 03, 04 are arranged spaced about the circumference U of the barrel 02, it is advantageous if the temperature-control medium flows in counterflow through adjacent hollow bodies or conducts 03, 04. If several hollow bodies 03, 04 are provided in the outer area of the barrel 02, or its base body 17, it is advantageous to arrange all of these hollow bodies or conducts 03, 04 at the same radial distance a3, a4 from the longitudinal axis 06 of the rotating body 01, as well as equidistant from each other in the direction of the circumference U of the barrel 02, so that as uniform a temperature control as possible of the shell face 07 of the barrel 02 can thus be achieved.

The hollow body or conduct 03, 04 in the rotating body 01, which has been produced by casting techniques, has a narrow interior diameter D3, D4, with the interior diameter D3, D4 preferably being less than 25 mm, and in particular being between 15 mm and 20 mm. A channel of such a narrow interior diameter D3, D4 is difficult to produce using conventional casting technology, by the insertion of a casting core into a barrel 02, or base body 17, to be cast. It has previously been attempted to drill such a channel into the barrel 02, or its base body 17. Such drilling, however, is expensive to accomplish over the length L of the barrel 02, or its base body 17 and is not without problems in its technical execution.

In accordance with the first embodiment of a method for producing a rotating body 01 to insert a pipe-shaped hollow body 03, 04, such as, for example a hollow body 03, 04 which is embodied as a pipe, and preferably as a steel pipe, into a casting mold for the barrel 02, or its base body 17, and to cast around it. To insure that during the casting process for the barrel 02, or its base body 17, the hollow body 03, 04 does not become soft, as a result of its being heated, by a temperature action of the molten material of the barrel 02, or its base body 17, and thus does not become deformed, it is necessary to embody the hollow body 03, 04 as being comparatively thick-walled, with respect to its inner diameter D3, D4. A wall thickness of the hollow body 03, 04 is thus, preferably at least one-fifth of the inner diameters D3, D4. A suitable wall thickness of the pipe-shaped hollow body 03, 04 is preferably at least 3 mm, and in particular is between 5 mm and 6 mm. Furthermore, the pipe-shaped hollow body 03, 04 can also be fixed in place and can be stabilized in the casting mold for the barrel 02, or its base body 17, by support elements.

As depicted in FIG. 2, the barrel 02, or its base element 17, can be configured as a hollow cylinder 02, into whose ring-shaped wall the pipe-shaped hollow body 03, 04 is sealed. In a printing press, and in particular in an offset printing press, the hollow body 01 can be used as a cylinder 01 which is guiding a material to be imprinted, or as a roller 01 which is guiding a material to be imprinted, or as a roller 01 in an inking unit or a dampening unit.

If, for example, the rotating body 01 is utilized as a cylinder 01 of a printing group, this cylinder 01 can be, for example, a forme cylinder 01 or a transfer cylinder 01 of an offset printing press, and wherein this cylinder 01 can be covered, in the direction of its circumference U, with, for example, one dressing or two dressings, and axially, in a direction over its length, with, for example, up to six dressings. In connection with a forme cylinder 01, the dressings are typically embodied as plate-shaped printing formes. In connection with a transfer cylinder 01, the dressings are preferably rubber printing blankets that are applied to a support plate. As a rule, such a plate-shaped printing forme, or such a support plate for a rubber printing blanket, is made of a flexible, but otherwise dimensionally-stable material, such as, for example, an aluminum alloy.

The printing group, in which the above-described cylinder 01 is employed, can be configured, for example, as a 9-cylinder satellite printing unit, in which satellite printing unit four cylinder pairs, each consisting of a forme cylinder 01 and of a transfer cylinder 01, are arranged around a common counter-pressure cylinder, and wherein, for example, at least each of the forme cylinders 01 can have the structure to attain the characteristics of the object of the present invention described here. Arrangements are advantageous, in particular for printing newspapers, in which a forme cylinder 01 is covered, in its axial direction, side-by-side with up to six plate-shaped printing formes, and along its circumference U either with one plate-shaped printing forme or with two plate-shaped printing formes arranged one behind the other. Such a forme cylinder 01 rolls off on a transfer cylinder 01 which, for example, is covered with up to three axially side-by-side arranged rubber printing blankets, and wherein each such rubber printing blanket stretches over the full circumference U of the transfer cylinder 01. Thus, as a rule, the rubber printing blankets have twice the width and twice the length of the plate-shaped printing formes which are used for the forme cylinder 01 that are acting together with the transfer cylinder 01. In this case, the forme cylinder 01 and the transfer cylinder 01 preferably have the same geometric dimensions with respect to their axial length and their circumference U. For example, a rotating body 01, which is embodied as a cylinder 01, has a diameter D2 of from 140 mm to 420 mm, and, for example, of preferably between 280 mm and 340 mm. The axial length of the barrel 02 of the cylinder lies, for example, in the range of from 500 mm to 2400 mm, and preferably lies between 1200 mm and 1700 mm.

The explanations provided above, regarding the arrangement and the employment of the rotating body 01 are intended to apply, in a corresponding manner, to all of the subsequent embodiments hereinafter to be described.

Figure 3:
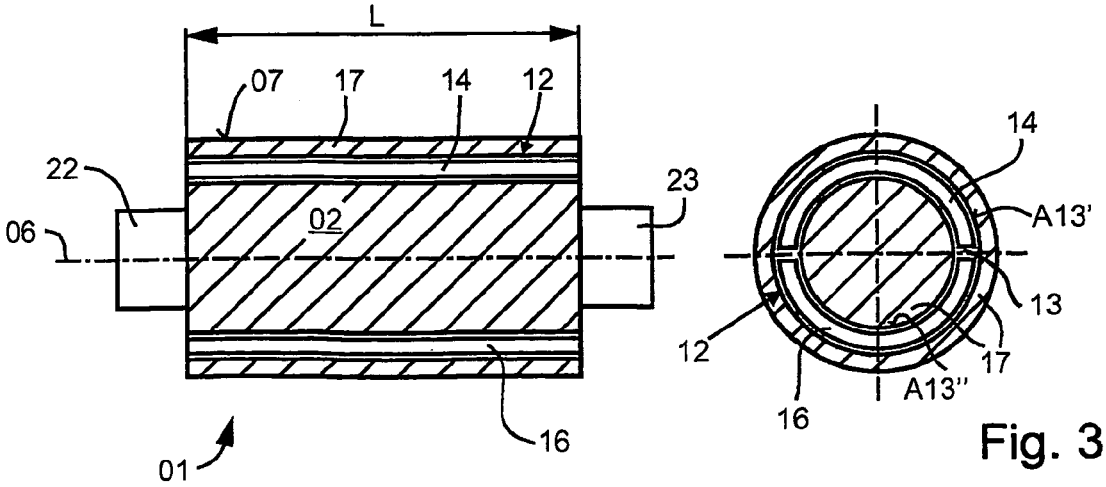

As represented in FIG. 3, a second preferred embodiment of the rotating body 01 of a printing press in accordance with the present invention can provide that at least one body 12 is arranged in the barrel 02 of the rotating body 01, or at least in a base body 17 of the barrel 02 made from a castable material, wherein, in a section taken transversely to the axial direction of the rotating body 01, the body 12 is bordered by two self-contained demarcation faces A13', A13", which are spaced apart from each other in the radial direction of the rotating body 01. Body of these demarcation faces A13', A13" border the material of the barrel 02 with their sides facing away from the body 12. In an interior 13 of the body 12, which interior 13 is bordered by the demarcation faces A13', A13", at least one channel 14, 16, which is bordered by the material of the body 12 and which extends in the axial direction of the rotating body 01, is formed.

In this case, the body 12 can be configured as a cast part which is produced by casting technology, typically as a precast component, wherein the cast part has at least one hollow space in its interior 13 for the formation of at least one channel 14, 16. Alternatively, the body 12 can also be a stamped or a continuously cast product. The body 12 is made of a strong material. A hollow space is formed in this body, preferably close to its demarcation face A13' facing the shell face 07 of the barrel 02. The hollow space is bordered by the material of the body 12, at least in its longitudinal direction. Preferably, the body 12 is homogeneous and is embodied as one piece, or also in several pieces, in the direction of the circumference U of the rotating body 01.

The body 12 advantageously is made of a heat-resistant material, such as, for example, a ceramic material or a hardened metal foam. The heat resistance is necessary so that the body 12 will not be deformed when molten material of the barrel is cast around it during production of the rotating body 01. An inclusion of the body 12, into the barrel 02 of the rotating body 01, which is simple in manufacturing technology terms results, if at least the barrel 02, or its base body 17 are made of a cast material, such as, for example, of metal, ceramics, glass or plastic, and the body 12 is sealed in the barrel 02, or in its base body 17 and is enclosed by the cast material. For this purpose, in the course of the production process utilized for producing the rotating body 01, the body 12 can be placed into the casting mold which will be used for casting the barrel 02, preferably in the outer area of the to be cast barrel 02, and will be fixed in place with the possible aid of support elements, and then sealed so that the body 12 is completely enclosed in the casting material of the barrel 02. In the situation of a ring-shaped or annular embodiment of the body 12, the space it is enclosed by is preferably filled by the casting material of the barrel 02, so that the body 12 is at least surrounded by the casting material.

Since a temperature-control medium is intended to flow through the channel 14, 16 in the interior 13 of the body 12, in order to control the temperature in at least a partial area of the shell face 07 of the barrel 02, the body 12 is advantageously arranged in the radially outer area of the barrel 02. If the entire shell face 07 of the barrel 02 is to be temperature-controlled, the body 12 with its channel 14, 16 advantageously extends over the entire length L of the barrel 02. At least the area of the shell face 07 of the barrel 02 that is corresponding to the area on the shell face 07 of the barrel 02, which is used for printing, must be temperature-controlled. As was the case in the first preferred embodiment, the rotating body 01 can again be a cylinder 01 that is used for guiding material to be imprinted, or a roller 01 used for guiding a material to be imprinted.

A further advantageous embodiment of the body 12 in accordance with the present invention lies in structuring it to be cylinder-shaped, and to preferably match the length of the body 12 to the length L of the barrel 02. Therefore, the body 12 preferably has the shape of a hollow cylinder or annulus, wherein the space bounded by it can be filled with the material of the barrel 02. In this case, the body 12 preferably encloses the longitudinal axis 06 of the rotating body 01. The channels 14, 16, extending in the axial direction of the rotating body 01, can, in a manner similar to the embodiment represented in FIGS. 1 and 2, extend parallel, with respect to the longitudinal axis 06 of the rotating body 01, or can also be arranged helically in the outer area of the barrel 02, or of the base body 17. If several channels 14, 16 are provided in the body 12, the temperature-control medium can pass in counterflow through adjacent ones of these channels 14, 16.

In the first two embodiments of the rotating body 01 in accordance with the present invention, as described above, it has been assumed, for the sake of simplicity, and without restricting the invention, that the rotating body 01 is homogeneously constructed, and that the barrel 02 does not have any layered construction which is concentric with respect to the shell face 07. Otherwise, a distinction would always have to be made between the barrel 02 and its base body 17, wherein the base body 17 and an outer body 19 surrounding it constitute the barrel 02. Here, the description is intended to apply to both embodiments.

Figure 4:
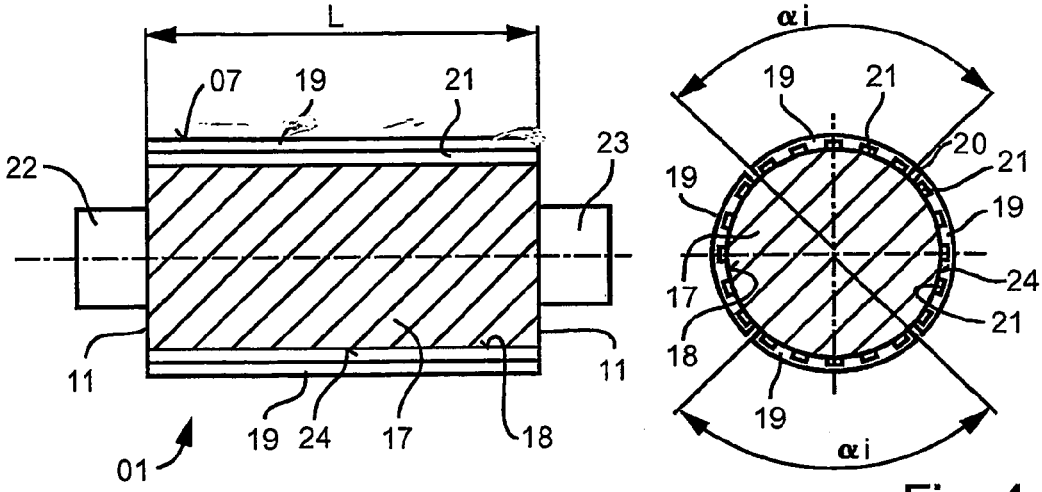

A third embodiment of the rotating body 01 of a printing press, in accordance with the present invention, is shown in FIG. 4. The barrel 02 of this rotating body 01 consists of at least a base body 17 with a cylindrical surface 18, and wherein at least one outer body 19 has been applied to the cylindrical surface 18 of the base body 17. The outer body 19 preferably consists of at least one curved element, whose associated central angle $\alpha$ is less than 360°. Particularly in connection with a rotating body 01, which is embodied as a forme cylinder 01 or as a transfer cylinder 01, the outer body 19 does not form a closed ring in its cross section, but instead has at least one gap 20 which can be used, for example, in connection with a holding device which is not represented in FIG. 4, and which is used for holding dressings applied to the rotating body 01. In connection with rollers which are not to be covered with a dressing, the outer body 19 can be embodied as a closed ring, which closed ring 19 encloses the base body 17 and is connected with the surface 18 of the latter. In an alternative to the above-mentioned embodiment, several outer bodies 19 can also be applied to the surface 18 of the base body 17. These several outer bodies 19 are arranged, on the surface 18 of the base body 17, in the direction of the circumference U of the base body 17. In the latter case, each outer body 19 consists of a curved element, wherein the sum of the central angles $\alpha i$, in which i is a counting index of the number of curved elements, which are subtended by the curved elements, complement each other to no more than 360°. In particular, two curved elements can be arranged, preferably symmetrically in respect to each other, at the circumference U of the base body 17. The central angle $\alpha i$, where i is a counting index of the curved elements, of each curved element preferably is slightly less than 180°. It is thus possible to provide curved elements of the outer body 19 in, for example, the form of half-shells or of quarter-shells. A gap 20 between individual curved elements of the outer body 19 can be a slit-shaped opening facing toward a bracing or securement channel, which is, for example, arranged in the base body 17, and which is provided with the previously mentioned holding device, and wherein the gap 20 can have a gap width of, for example, less than 3 mm, and preferably of from 1 mm to 2 mm. In both cases of the last mentioned preferred embodiment, as seen in FIG. 4, at least one hollow space 21 is provided in the outer body 19, and wherein the hollow space 21 is open toward the surface 18 of the base body 17. The outer body 19 constitutes the outermost component of the barrel 02, so that the outer surface of the outer body 19, constituting the shell face of the barrel 02, can be covered with one or with several dressings. The dressing, or the dressings, are each maintained on the rotating body 01 by the holding device which is arranged in the barrel 02, and, in particular, in its base body 17, in a bracing or securement channel. If the outer body 19 is embodied as a multi-part assembly, and preferably is embodied as at least two curved elements, each with a central angle $\alpha i$, where i is a counting index of the curved elements, of, at most, of 180°, the advantage arises, in the course of producing the rotating body 01, that it is not necessary to introduce the base body 17, with an exact fit, into the outer body 19. Instead, the curved elements can be applied to the surface 18 of the base body 17 by the use of a suitable releasable, or preferably by the use of a non-releasable connecting technique, such as for example, by the use of screws or by welding.

Figure 5:
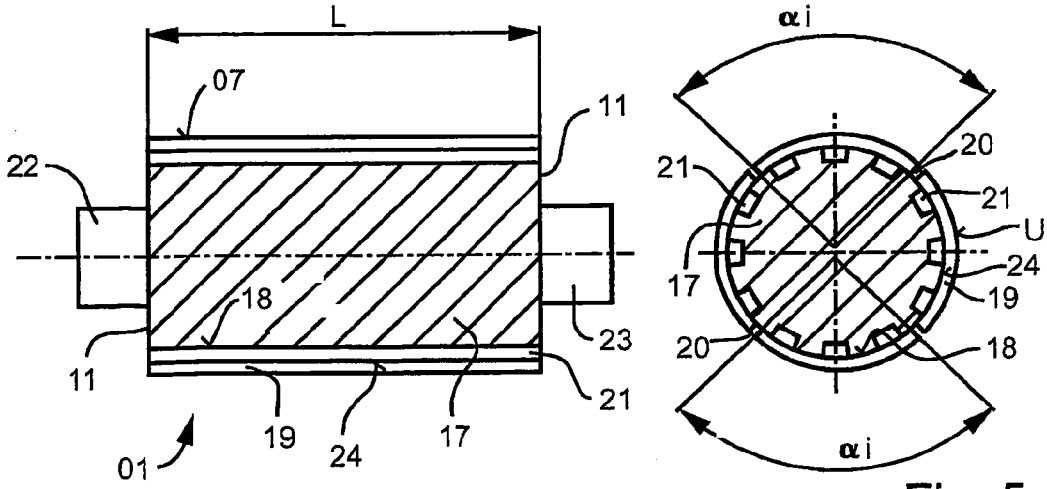

As seen in FIG. 5, the rotating body 01 can also be configured in such a way that its barrel 02 consists of at least one base body with a cylindrical surface 18, and wherein a hollow space 21, which is open toward the surface 18 of the base body 17, is provided in the base body 17. An outer body 10, which is attached to the surface 18 of the base body 17, covers the hollow space 21. The outer body 19 consists of a curved element, whose associated central angle $\alpha$ is less than 360°. With this variation, the barrel 02 of the rotating body 01 can alternatively consist of a base body 17 with a cylindrical surface 18, and wherein several hollow spaces 21, which are open toward the surface 18 of the base body 17, are provided in the base body 17. Several outer bodies 19 are arranged on the surface 18 of the base body 17, in the direction of the circumference U of the base body 17, and the outer bodies 19, which are attached to the surface 18 of the base body 17, cover the respective hollow spaces 21. In the latter case, each outer body 19 consists of a curved element, wherein the central angles $\alpha i$, where i is a counting index of the number of curved elements, which belong to the curved elements, complement each other to no more than 360°.

With a rotating body 01 in accordance with the third preferred embodiment, as shown in FIGS. 4 and 5, namely a rotating body 01 that is consisting of a base body 17 with a massive, and in particular with a not compressibly embodied outer body 19, of constant radial thickness d19, attached to the base body 17, the outer body 19 can be glued, welded or screwed, for example, to the surface 18 of the base body 17. Accordingly, the outer body 19 can be attached either permanently or releasably to the surface 18 of the base body 17. Electron beam welding methods or laser beam welding methods are particularly well-suited welding processes. In this case, it can be sufficient for fastening the outer body 19 onto the base body 17 if the outer body 19 is connected as a material-to-material connection, or as a positive connection with the surface 18 of the base body 17 only at the ends 11 of the barrel 02 in the above-mentioned way. A welding seam, for example, need not extend over the entire length L of the rotating body 01, and instead can be embodied, for example, in the form of points, or in the form of several short sections of only a few millimeters length, which points or sections are spaced apart from each other. The welded sections can be, for example, 5 mm to 25 mm long, and preferably are approximately only 10 mm long. They can be repeated at distances of from 20 mm to 50 mm, and preferably at distances from 30 mm to 40 mm, in the axial direction of the rotating body 01.

The rotating body 01 can be configured in such a way that at least the base body 17, and if desired, together with journals 22, 23 which are adapted for seating and for driving the rotating body 01, and which are formed at the ends 11 of the barrel, is forged, or that at least the outer body 19 is made of steel. In the preferred embodiment show in FIG. 5, a temperature-control medium flows through a hollow space 21, which can be cut, for example by milling, into the base body 17 or into an inside 24 of the outer body 19 as seen in FIG. 4, for example, for use in controlling the temperature of the shell face 07 of the barrel 02. The hollow space 21 constitutes a channel 21 for the temperature-control medium. The hollow space 21 can be arranged in the barrel 02 in such a way that the insertion of beveled or angled ends of dressings, which dressings are to be placed on the shell face 07 of the barrel 02, to a bracing or securement channel arranged, in the customary manner, in the base body 17 is not hindered. A slit-shaped opening of a slit width "S" of less than 3 mm at the shell face 07 of the barrel 02 and extending axially with respect to the rotating body 01, is sufficient for this access. Thus, the base body 17 and the outer body 19 are joined in such a way that they seal the hollow space 21. The hollow space 21 can be aligned axially, with respect to the barrel 02, or can extend in a sinusoidal-like manner along the length "L" of the barrel 02. If several hollow spaces 21 are provided, it is advantageous to arrange them equidistant from each other along the circumference U of the barrel 02. As in the previously described embodiments, the rotating body 01 can be a cylinder 01 for guiding material to be imprinted, or a roller 01 for guiding material to be imprinted.

A variation of the third embodiment, as shown in FIG. 4, however without the gap 20 in the outer body 19, relates to a rotating body 01 of a printing press with a barrel 02, wherein the barrel 02 has at least one base body 17 with a cylindrical surface 18, and an outer body 19 which completely surrounds the surface 18 of the base body 17. The rotating body 01 in this variation is distinguished in that the outer body 19 has, on its inside 24 at least one channel 21 which is open toward the surface 18 of the base body 17. The outer body 19 preferably rests on the surface 18 of the base body 17. The outer body 19 and the base body 17 can be placed atop each other, for example with a press fit. In this embodiment, with a self-contained ring-shaped outer body 19, it is possible, following the application and the fastening of the outer body 19 on the surface 18 of the base body 17, to cut, such as, for example, by milling and as required, a gap 20 and an associated bracing or securement channel, or several such gaps 20 and associated bracing or securement channels, into the rotating body 01, preferably at a location where no channel 21 is formed on the outer body 19. The gap 20 need not extend over the entire length L of the barrel 02. The outer body 19 thus remains free of gaps, at least at the ends 11 of the barrel 02, and therefore remains connected.

Figure 6A:
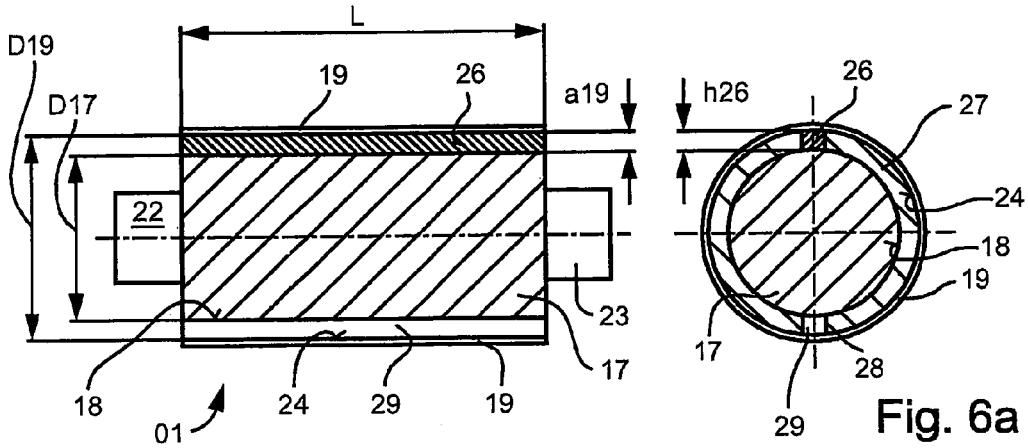
Figure 6B:
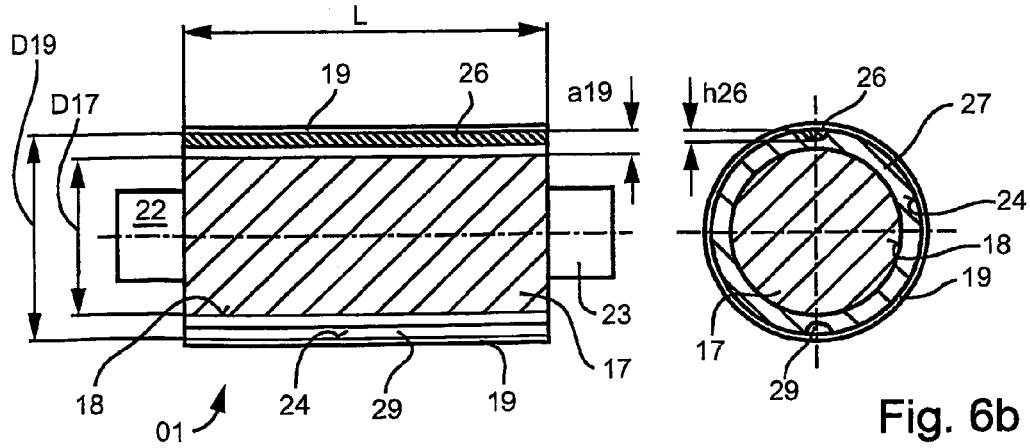

In a fourth preferred embodiment of the rotating body 01 of the present invention, initially a method of producing it will be explained. This method starts, as can be seen in FIGS. 6*a* and 6*b*, with a rotating body 01 of a printing press and having a barrel 02. The barrel 02 has at least one base body 17 with a cylindrical surface 18, and an outer body 19, which can surround the surface 18 of the base body 17 and which is spaced therefrom at a distance a19. The method of this fourth preferred embodiment is distinguished from other embodiments in that at least one strip 26, which is made of a material that can be liquefied by heating, is initially attached to the inside 24 of the outer body 19, or to the surface 18 of the base body 17. The outer body 19 and the base body 17 are then mounted, coaxially covering each other, in that they are preferably pushed onto each other. A hollow space 27 remaining between the base body 17 and the outer body 19, namely at a location where there is no strip 26 is then filled with a hardenable casting material. Finally, following the hardening of the casting material, at least the outer body 19 is heated in such a way that the material of the strip 26 is liquefied and is removed from the space 27 between the base body 17 and the outer body 19. In this case, the material of the strip 26 can be, for example, plastic or wax. A synthetic resin, preferably a two-component resin, which solidifies and hardens, for example at room temperature or at a temperature up to 100° C., is suited as the casting material for filling the space 27 between the base body 17 and the outer body 19, for example. A melting point of the casting material, which can, for example, lie at 350° C., must, in any case, be higher than a melting point of the strip 26, which melting point can, for example, lie at 150° C. In this way, is it provided that, by the use of the synthetic resin placed into the space 27 between the base body 17 and the outer body 19, that the outer body 19 is firmly connected with the base body 17. However, as an alternative to the synthetic resin, an aluminum foam, which hardens, can also be suitable for filling the space 27.

After the at least one strip 26, which had been arranged between the base body 17 and the outer body 19, has been removed, preferably thermally, the casting material bordering the previous strip 26 forms a guide surface 28 of a channel 29 after this casting material has become rigid or has hardened. The casting material placed into the space 27 seals the channel 29 along its guide surface 28 toward the base body 17 and the outer body 19. The strip 26 can, for example, also extend helically over the length L of the barrel 02, preferably in its outer area. A radial extension of the strip 26, i.e. its height h26 can be as great as the distance a19 between the base body 17 and the outer body 19, as seen in FIG. 6*a*. However, the height h26 of the strip 26 is preferably made shorter than the distance a19 between the base body 17 and the outer body 19, as seen in FIG. 6*b*, so that when the space 27 between the base body 17 and the outer body 19 is filled, the casting material forms a bottom on the surface 18 of the base body 17. In both cases, the height h26 of the strip 26 corresponds to the height h26 of the channel 29. When, in the course of the operation of the rotating body 01, a temperature-control medium flows through the channel 29 formed by the removal of the removable strip 26, the casting material forms a thermal insulating layer toward the base body 17 which thermal insulating layer is particularly effective if the channel 29 has a bottom toward the base body 17. The temperature-control medium is thus active only toward the outer body 19. The base body 17 remains protected against thermal effects. The casting material is used in this way as an insulating material. For achieving this insulative effect, a casting material with glass beads, preferably with hollow glass bodies, and in particular with hollow glass spheres, sprinkled in, is particularly advantageous. It is also advantageous to select an insulating material, for example, a synthetic resin, whose thermal coefficient of expansion corresponds, as closely as possible, to that of the material of the base body 17 and to the outer body 19 and therefore matches it. In the course of their assembly, the outer body 19 and the base body 17 are oriented concentrically in respect to each other.

In the above-described fourth embodiment, at least the barrel 02 of the rotating body 01 has a base body 17 with a cylindrical surface 18 and also has an outer body 19 surrounding the surface 18 of the base body 17, as shown in FIGS. 6*a* and 6*b*. An inner diameter D19 of the outer body 19 is greater than an outer diameter D17 of the base body 17. The rotating body 01 is distinguished in that a casting material, which preferably is an insulating material, and in particular is a castable insulating material, has been placed into a space 27 between the surface 18 of the base body 17 and the inside 24 of the outer body 19, and the casting material, or the insulating material forms at least one channel 29 in the space 27. It is advantageous if the inner diameter D19 of the outer body 19 is between 5 mm and 30 mm greater, and in particular is 20 mm greater than the outer diameter D17 of the base body 17, and if the outer body 19 is concentrically arranged around the base body 17. The channel 29 can also wind in a helical or other actuate shape around the base body 17, preferably in the outer area of the barrel 02. In a manner similar to the previously described preferred embodiments, a temperature-control medium can flow through the channel 29. It is advantageous, in connection with the preferred use of the rotating body 01, if the outer body 19 is embodied as a steel pipe and the base body 17 is forged.

Figure 7:
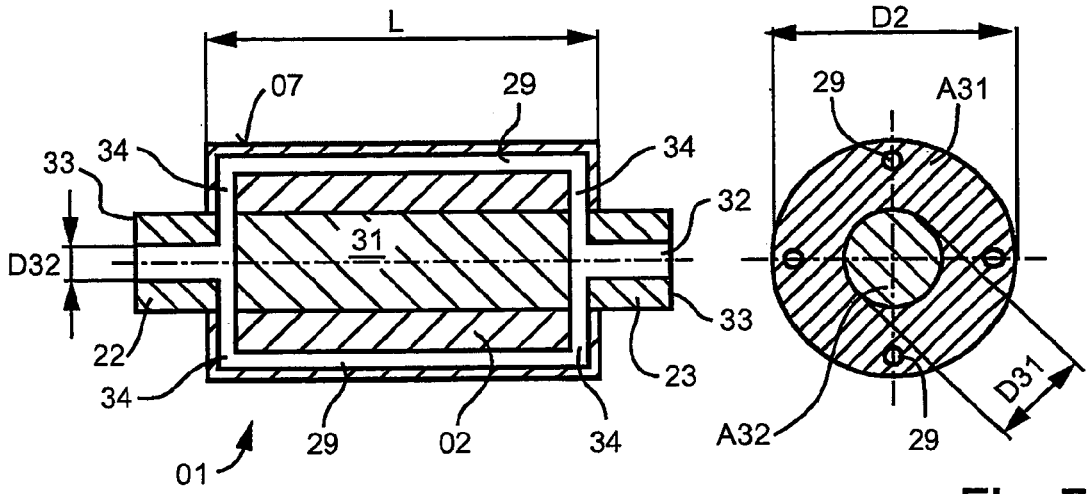

As represented in FIG. 7, a fifth preferred embodiment of the present invention provides a rotating body 01 of a printing press, having a barrel 02, and wherein a shaft 31, with a diameter D31, and preferably passing through the barrel 02, is arranged centered in the barrel 02. The shaft 31 has a higher resistance against mechanical stress exerted on the rotating body 01 than does the barrel 02, and preferably has a greater physical strength, in particular a higher endurance, and a higher breaking or flexing resistance, than the barrel 02, and further wherein at least one channel 32 leading into the barrel 02 is provided in the shaft 31. In particular, the shaft 31 consists of a high-strength material, with an appropriate modulus of elasticity for positioning in it a channel 32 extending to the inside of the barrel 02 and of a diameter D32 and with channel 32 having as large as possible a cross-sectional surface A32 in comparison with the cross-sectional surface A31 of the shaft 31, and without reducing the physical properties of the entire rotating body 01, such as for example its endurance, or its breaking or flexing resistance. Since the physical properties of the material being used for the barrel 02, such as, for example, an iron-containing or an aluminum-containing material, are not too great, it would not be possible to provide a channel 32 having a large cross-sectional surface A32, and for use in introducing as large as possible a volume flow of a temperature-control medium into a hub of the barrel 02 which is made of the same material as the remaining barrel 02, without negatively affecting the physical properties of the rotating body 01. The physical strength of the material used for the shaft 31 should permit the provision of a channel 32 with a large cross-sectional surface A32 in it. An axial bore, with a diameter 32 of between 8 mm and 30 mm, for forming the channel 32, can be advantageously cut into the shaft 31, wherein the diameter D32 of the channel is approximately 40% of the diameter D31 of the shaft 31. With this construction, the cross-sectional surface A32 of the channel 32 can be approximately 20% or more of the cross-sectional surface A31 of the shaft 31. Despite the formation of such a channel 32 in the shaft 32, the geometric dimensions of the shaft 32, in comparison with conventional shafts 32, should remain unchanged and should, in particular, not be increased. Instead, with constant mechanical stress, the increased physical strength of the shaft 32 compensates for its weakening that was caused because of the channel 32 having been cut into it. The channel 32 is formed on at least one end 33 of the shaft 31, as seen in FIG. 7, and extends in the barrel 02, for example, over only a portion of the length L of the barrel 02. Advantageously, the shaft 31 itself extends as a component, which, with respect to its structure and its material, is formed homogeneously and as one piece, at least over the length L of the barrel 02, wherein this length L, as previously mentioned, can reach up to 2400 mm. Moreover, the shaft 31 can be embodied, at its ends, with journals 22, 23 for seating and for connection with a drive mechanism for accomplishing the rotary movement of the rotating body 01. A temperature-control medium, for controlling the temperature of the barrel 02, is conducted through the channel 32 into the barrel 02. A rotary lead-through can be connected with the shaft 31, in particular with at least one of its journals 22, 23. For controlling the temperature of the shell face 07 of the barrel 02 which, shell face 07 can for example, be covered with at least one dressing, the barrel 02 has at least one channel 29 extending underneath the shell face 07. The channel 29 of the barrel 02 is connected with the channel 32 of the shaft 31 by at least one line that is extending substantially radially with respect to the barrel 02, such as, for example a radial bore 34, or by an annular groove 37, as represented in FIG. 2. In a preferred embodiment, at least the barrel 02 is made of a casting material, wherein the channel 29 of the barrel 02 is enclosed, for example, by the cast material of the barrel 02, or is structured in accordance with one of the previously described preferred embodiments of the rotary body 01. Therefore, the barrel 02 can be made of, for example, a gray cast material, a cast steel or a cast aluminum, while the shaft 32 is made, for example, of a preferably alloyed or tempered steel, and in particular of a high-strength steel with an appropriate module of elasticity. The rotating body 01 is thus constructed using two components of preferably different material, with different physical properties and with melting points which are different from each other. The shaft 31 is introduced into the barrel 02, by the use of a non-positive, material-to-material, or positive connection, and is connected with the barrel 02 in such a way that the channels 29, 32, which are formed in the barrel 02 and in the shaft 31, have a connection through which the temperature-control medium can flow. If the physical strength of the shaft 31 permits it, the shaft 31 can be cast in the barrel 02. However, in the present preferred embodiment, the cast barrel 02 is attached to the shaft 31 by being shrunk onto it. Further possible joining techniques consist of gluing the shaft 31 into the barrel 02, to clamp it by forming, or by the introduction of suitable assemblies such as, for example, wedges or a tongue-and-groove connection. In connection with a method for producing the rotating body 01, wherein a shaft 31 with a channel 32 of a large cross-sectional surface A32 is arranged centered in the barrel 02, and wherein the shaft 31 is introduced into a barrel 02 which was produced by casting technology, after the barrel 02 has solidified, the danger of a thermal deformation of the shaft 31, or at least of thermal stresses in the shaft 31, which would otherwise exist, is avoided, in particular in connection with slim rotating bodies 01 of a relatively small diameter D2 and therefore with a large axial length L, as previously mentioned. With this method, heating, and especially heat-soaking and softening of the shaft 31, by the liquefied casting material of the barrel 02, is prevented, since the shaft 31 is not embedded in the casting material of the barrel 02 liquefied by heat. Instead, the shaft 31 is introduced into the cast barrel 02 after it has solidified. This method contributes to the production, with great precision, of rotating bodies 01 with a shell face 07 which is to be temperature-controlled.

Figure 8:
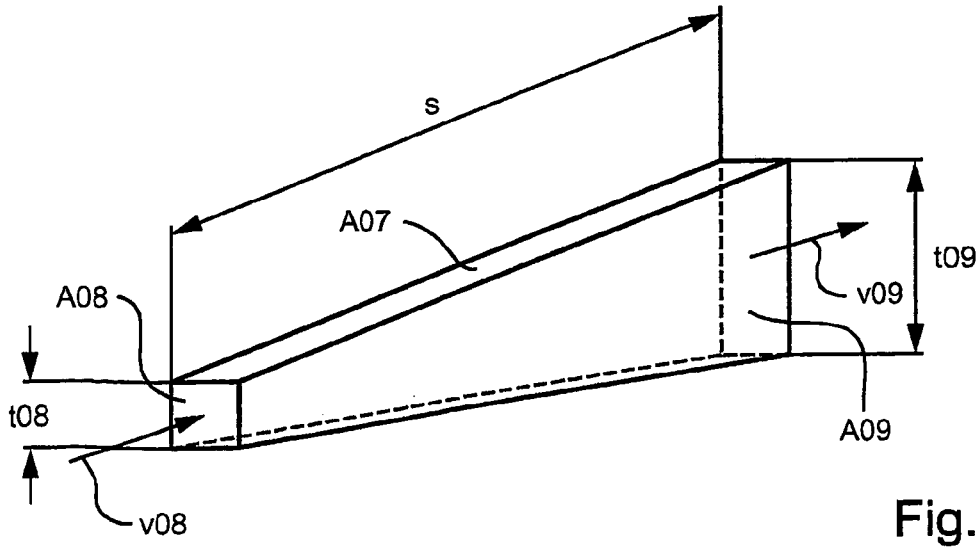

A method for the temperature-control of at least one barrel 02 of a rotating body 01 of a printing press, and in which at least the barrel 02 has at least one hollow body 03, 04, or channel 14, 16, 21, 29, with an inflow 08 and with an outflow 09 for the temperature-control medium, and through which a preferably liquid temperature-control medium flows at a constant flow volume, is provided. An amount of heat to be exchanged between the barrel 02 and the temperature-control medium in the hollow body 03, 04, or in the channel 14, 16, 21, 29, over a distance "s" between the inflow 08 and the outflow 09, and wherein the distance "s" preferably corresponds to the length L of the barrel 02, but corresponds at least to the length of the print-performing area on the shell face 07 of the barrel 02, is maintained constant by the adjustment of a flow speed v08, v09 of the temperature-control medium. In connection with this, an embodiment of the hollow body 03, 04, or of the channel 14, 16, 21, 29 can be seen in FIG. 8.

With this above-described method, the flow speed v08, v09 of the temperature-control medium can be adjusted wherein, for example, a cross-sectional area A09 of the hollow body 03, 04 or of the channel 14, 16, 21, 29 at the outflow 09 is changed, in comparison with a cross-sectional area A08 of the hollow body 03, 04 or channel 14, 16, 21, 29 at the inflow 08. Alternatively, the flow speed of the temperature-control medium can be adjusted wherein a depth t09 of the hollow body 03, 04 or of the channel 14, 16, 21, 29, at the outflow 09, is changed in comparison with the depth t08 of the hollow body 03, 04 or of the channel 14, 16, 21, 29 at the inflow 08. To this end, it is provided that a contact surface A07 of the temperature-control medium flowing through the hollow body 03, 04 or channel 14, 16, 21, 29 is kept constant. It is achieved, by these steps, that the heat exchange between the shell face 07 of the barrel 02 and the temperature-control medium remains constant. For example, in connection with a steadily warming temperature-control medium, because of the cooling of the contact surface A07, the flow speed v09 at the outflow 09 is reduced, in comparison with the flow speed v08 at the inflow 08, so that the dwell time of the temperature-control medium at the contact surface A07 is proportionally increased. On the other hand, it is also possible to maintain the flow speed v08, v09 of the temperature-control medium constant over the distance "s" and to change the contact surface A07 which the temperature-control medium has toward the shell face 07 of the barrel 02 by changing the geometry of the contact surface A07 or its distance toward the shell face 07 of the barrel 02.

In a sixth preferred embodiment of the present invention, the rotating body 01 of a printing press has a barrel 02, wherein at least one hollow body 03, 04 or a channel 14, 16, 21, 29, through which a temperature-control medium flows, and with an inflow 08 and an outflow 09 for the temperature-control medium, is at least located in the barrel 02. An amount of heat in the hollow body 03, 04 or in a channel 14, 16, 21, 29, which is to be exchanged between the barrel 02 and the temperature-control medium, over a distance "s" between the inflow 08 and the outflow 09, is kept constant by an adjustment of a flow speed v08, v09 of the temperature-control medium. In this case, the distance "s" advantageously corresponds to at least the print-performing area along the length L of the barrel 02.

As described in connection with the present method, the flow speed v08, v09 of the temperature-control medium can be adjusted. A cross-sectional surface A09 of the hollow body 03, 04 or the channel 14, 16, 21, 29, at the outflow 09, for example, can be changed in comparison with a cross-sectional surface A08 of the hollow body 03, 04 or the channel 14, 16, 21, 29 at the inflow 08. Alternatively, the flow speed of the temperature-control medium can be adjusted. A depth t09 of the hollow body 03, 04 or of the channel 14, 16, 21, 29 at the outflow 09 can be changed, in comparison with the depth t08 of the hollow body 03, 04 or of the channel 14, 16, 21, 29 at the inflow 08. With this rotating body 01, a contact surface A07 of the temperature-control medium flowing through the hollow body 03, 04 or through the channel 14, 16, 21, 29 and which is oriented toward the shell face 07 of the barrel 02 does not change. Also, the flow speed v08, v09 of the temperature-control medium along the distance "s" can remain constant and the contact surface A07 which the temperature-control medium has toward the shell face 07 of the barrel 02 can be changed between the inflow 08 and the outflow 09 in its geometry or in its distance from the shell face 07 of the barrel 02.

This sixth preferred embodiment of the rotating body 01, in accordance with the present invention, is particularly suited for configurations in which the inflow 08 and the outflow 09 of the temperature-control medium are arranged on the same end 11 of the barrel 02. For example, the effect of this sixth preferred embodiment of the rotating body 01 can be achieved wherein an insert, which changes the cross section along the distance "s" in a desired way, can be introduced into a hollow body 03, 04 or into a channel 14, 16, 21, 29 of constant cross section, and wherein this insert can be embodied to be wedge-shaped, for example. If the insert for the hollow body 03, 04 or for the channel 14, 16, 21, 29 is embodied as a solid wedge, such as, for example, a rod whose cross section is embodied in a desired way, and in particular as a plastic rod, this wedge can be introduced with a material-to-material contact or with positive contact into the hollow body 03, 04 or channel 14, 16, 21, 29, for example by gluing or by a press fit. Advantageously, the insert consists of an insulating material, and preferably of a castable insulating material, such as, for example, a synthetic resin with sprinkled-in hollow glass bodies, such as, for example, hollow glass spheres, which castable insulating material is preferably introduced into the hollow body 03, 04 or into channel 14, 16, 21, 29 by a casting process or by an injection-molding process, and which insulates the temperature-control medium against the base body 17 of the barrel 02 because of its thermal damping effect. In this embodiment, the insert at least partially lines the hollow body 03, 04 or the channel 14, 16, 21, 29 at its inner wall, i.e. at its wall facing the temperature-control medium. With a channel 14, 16, 21, 29 open toward the base body 17 arranged in the outer body 19, the insert placed, for example, into the channel 14, 16, 21, 29 covers the channel 14, 16, 21, 29 toward the base body 17.

The use of such an insert has as an advantage that the hollow body 03, 04 or the channel 14, 16, 21, 29 can be provided in the barrel 02 of the rotating body 01, for example, by the use of a conventional pipe, and in particular by a steel pipe, or by drilling or machining. An effect on the flow behavior of the temperature-control medium takes place in a production step which is separated from the insertion of the hollow body 03, 04 or of the channel 14, 16, 21, 29 into the barrel 02. Moreover, it is possible, by the use of an insert into the hollow body 03, 04 or into the channel 14, 16, 21, 29 to achieve, in a simple manner, a thermal insulation of the temperature-control medium against the base body 17.

Figure 9:
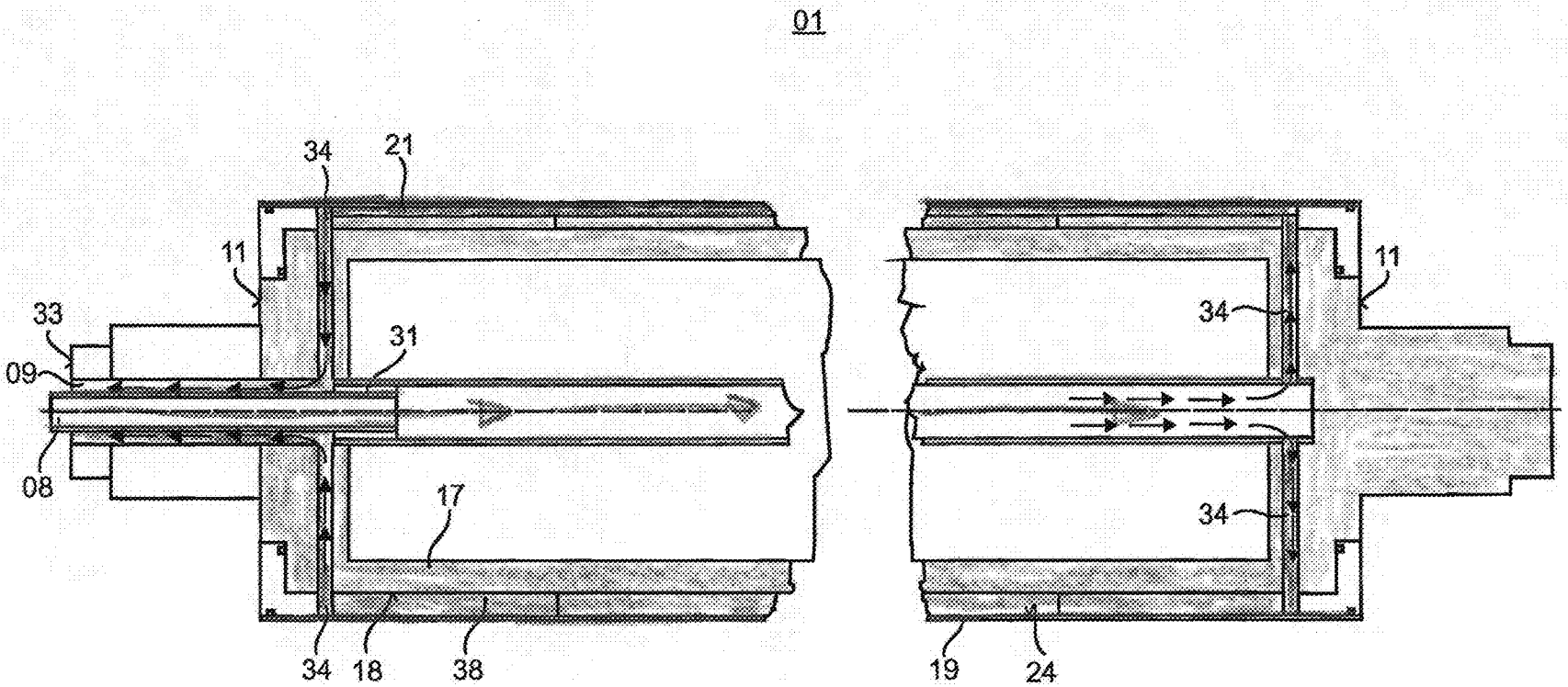
Figure 10:
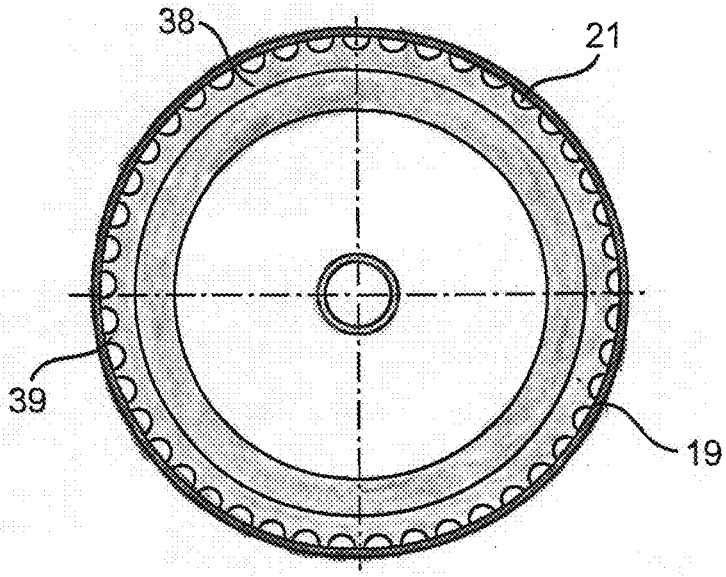
Figure 11:
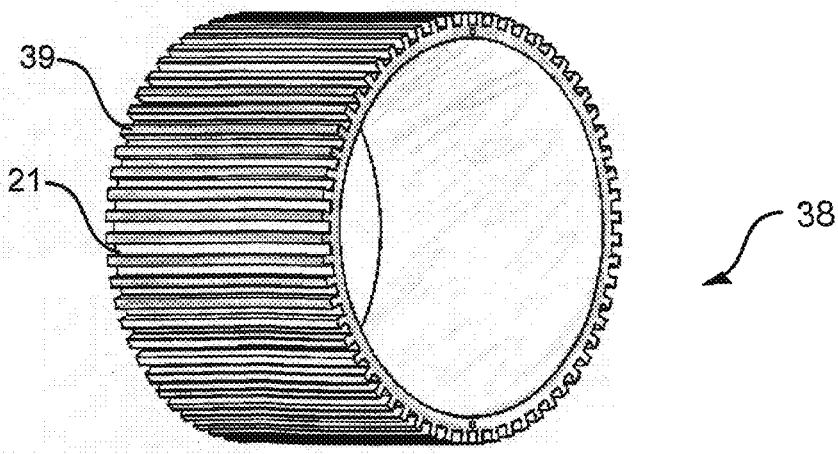

A further method, in accordance with the present invention, for producing a rotating body 01 with a thermally insulated base body 17, as well as a rotating body 01 which is produced in accordance therewith, will now be explained by reference to FIGS. 9 to 11. A cylindrical sleeve 38 is pushed onto the preferably closed cylindrical surface 18 of the base body 17 and extending over the axial length of the rotating body 01. The sleeve 38 has formed along its outer circumference several hollow spaces 21 in the form of, for example, grooves 21 which are extending axially with respect to the base body 17. Every groove 21 can preferably be used as a flow channel 21. Preferably, several sleeves 38, each preferably of the same axial width, have been lined up over the axial length of the rotating body 01, for example by pushing them on the rotating body 01. All of the grooves 21, located at the outside circumference of all of the sleeves 38 fit or align with each other to form a continuous flow channel 21 that is extending over the axial length of the rotating body 01. However, the sleeves 38 can also be produced with different axial widths, for example, so that sleeves 38 of different axial widths can fit to form almost any arbitrary axial length of the rotating body 01.

A channel-like inflow 08, for use in introducing the heat-carrying medium into the rotating body 01, is provided at least one first end 11 of the rotating body, or at an end 33 of a shaft 31 and continues extending through the rotating body 01. The heat-conducting medium is conducted, for example, in the interior of the shaft 31, through the rotating body 01, to a location which is close to the second, opposite end 11 of the rotating body 01. By flowing through preferably several radial bores 34, the heat-conducting medium is then conducted from the interior of shaft 31 to the openings of the grooves 21 of the sleeve 38 which, sleeve 38 in the axial direction of the rotating body 01, is the outermost one. This heat-conducting medium is introduced into the flow channels 21, which are embodied as grooves 21, after which the heat-conducting medium flows through the grooves 21 back in the direction of the first end 11 of the rotating body 01 at which end 11 of the rotating body 01 the heat-conducting material had been introduced into the rotating body 01. The heat-conducting medium exiting from the end openings of the grooves 21 of the sleeve 38 which, in the axial direction of the rotating body 01, is the last can be conducted by radial bores 34 to a channel-like outflow 09 for the collective removal of the heat-conducting medium from the rotating body 01.

In this preferred embodiment, all of the sleeves 38 are preferably made of a plastic material, typically in an injection-molding process, and are made, for example, of polyamide. The sleeves 38 are preferably made of a thermally insulating material. The grooves 21, which are formed in the outside of the sleeve 38, are preferably formed in the course of injection-molding the sleeve 38. These grooves 21 can also be cut into the outer surface of the sleeve 38 by milling or by a similar process.

Following the placement of the sleeves 38, which are preferably required for the entire axial length of the rotating body 01, onto the base body 17, and the alignment of their respective grooves 21, for forming the resultant continuous flow channels 21, the sleeves 38 are fixed in place on the base body 17, preferably by the use of a material-to-material connection, such as for example, by gluing, and are thereby fastened in place. Thereafter, an outer body 19, which may be, for example, embodied as a cylindrical pipe, is placed on the lined-up sleeves 38 in such a way that the grooves 21 cut into the sleeves 38 are covered. Strips or ridges 39, which are formed between the individual grooves 21, prevent leaks in which the heat-conducting medium flowing through the flow channels 21 would leak from one groove 21 into a neighboring groove 21 in an uncontrolled manner. The preferably thin-walled outer body 19 is pushed onto the sleeves 38, typically with a positive connection, and is fastened to the sleeves 38, or to the base body 17, or to both, preferably in a material-to-material connection, such as, for example, by welding or gluing. With this construction, at least one cylindrical sleeve 38, made of a thermally insulating material, has been placed into the space 27 between the surface 18 of the base body 17 and the inside 24 of the outer body 19. The outer body 19 preferably is made of a corrosion-proof and wear-resistant metallic material.

While preferred embodiments of rotating bodies of a printing press comprising a barrel, in accordance with the present invention, have been set forth fully and completely hereinabove, it will be apparent to one of skill in the art that changes in, for example, the source of supply of the heat-conducting material, the overall arrangement of the printing press, and the like could be made without departing from the true spirit and scope of the present invention which is to be limited only by the appended claims.

What is claimed is:

1. A rotating body of a printing press comprising:

a rotating body barrel of said printing press rotating body, said barrel including a base body having a base body axial length;

an outer body of said printing press rotating body, said outer body being positioned radially outside of, and spaced from said base body, said outer body having an outer body axial length at least equal to said base body axial length;

an outer, closed cylindrical surface on said base body;

an inner surface on said outer body, said inner surface on said outer body being spaced from said outer closed cylindrical surface on said base body and cooperating with said outer closed cylindrical surface on said base body to define a fluid impermeable annular space;

a plurality of sleeves, each of a thermal insulating material supported on said base body, said plurality of sleeves each having a sleeve axial length less than said base body axial length, said plurality of sleeves being axially abutting and being enclosed in said annular space, each said sleeve having a sleeve inner surface in contact with said outer surface of said base body and having a sleeve outer surface in contact with said inner surface of said outer body, said plurality of axially abutting sleeves having a combined sleeve axial length not greater than said base body axial length;

a plurality of axially extending, circumferentially spaced temperature control medium flow channels in each said sleeve, each said channel being formed in said outer surface of its one of said plurality of sleeves of said thermal insulating material, each said channel being thermally insulated from said base body by said thermal insulating material, said axially extending, circumferentially spaced channels in said axially abutting ones of said plurality of sleeves being aligned to each other to form continuous ones of said plurality of axially extending temperature control medium flow channels; and at least one fluid inflow for a temperature control medium at a first end of said base body and at least one fluid outflow for said temperature control medium at a second end of said base body, each of said plurality of temperature flow channels in said sleeves receiving said temperature control medium from said fluid inflow and providing axial flow of said temperature control medium through each of said continuous ones of said plurality of axially extending temperature control medium flow channels to said at least one fluid outflow to exchange an amount of heat between said outer body of said rotating barrel and said temperature control medium over each said continuous channel in said abutting ones of said plurality of sleeves during flow of said temperature control medium through each said continuous channel from said fluid inflow to said fluid outflow, while being thermally insulated from said base body.

2. The rotating body of claim 1 wherein each said channel is open toward said outer body inner surface.

3. The rotating body of claim 1 wherein each said channel has a bottom facing toward, and spaced from said base body outer surface.

4. The rotating body of claim 1 wherein each said channel is formed in its respective one of said sleeves of a thermal insulating material by casting.

5. The rotating body of claim 1 wherein each of said sleeves of said thermal insulating material, said base body and said outer body have matched coefficients of thermal expansion.

6. The rotating body of claim 1 further including hollow glass bodies in each said sleeve of said thermal insulating material.

7. The rotating body of claim 1 wherein each said sleeve of said thermal insulating material is cast between said base body surface and said outer body inner surface.

8. The rotating body of claim 1 wherein each said sleeve of said thermal insulating material is an injection-molded plastic.

9. The rotating body of claim 1 wherein each said channel in each said sleeve of said thermal insulating material is formed by injection molding.

10. The rotating body of claim 1 wherein said outer body has an outer body outer shell surface and wherein each said channel is located not more than 20 mm underneath said outer body outer shell surface.

11. The rotating body of claim 1 wherein each said sleeve of said thermal insulating material is a synthetic resin.

12. The rotating body of claim 1 wherein said outer body includes an outer shell face which is adapted to support at least one dressing.

13. The rotating body of claim 1 wherein said outer body is a curved element which at least partially encloses said base body.

14. The rotating body of claim 13 wherein said curved element has a central angle less than 360°.

15. The rotating body of claim 1 wherein said rotating body is one of a forme cylinder and a transfer cylinder of the printing press.

16. The rotating body of claim 1 wherein said rotating body is a roller in an inking unit of the printing press.

17. The rotating body of claim 1 wherein said plurality of said sleeves of said thermal insulating material are of differing axial lengths.

18. The rotating body of claim 1 wherein said outer body is a cylindrical pipe.

19. The rotating body of claim 1 wherein said outer body is thin-walled.

20. The rotating body of claim 1 wherein said outer body is positioned on top of said plurality of sleeves.

21. The rotating body of claim 1 wherein said outer body is positively connected to said plurality of sleeves.

22. The rotating body of claim 1 wherein said outer body covers said plurality of axially extending temperature control medium flow channels.

23. The rotating body of claim 1 wherein said outer body is a corrosion-proof and wear-proof metallic material.

24. The rotating body of claim 1 wherein each of said plurality of sleeves is a plastic material.

25. The rotating body of claim 1 further including strips formed between said grooves, said strips being in engagement with said inner surface of said outer body.

* * * * *